United States Patent [19]

Kanou

[11] 4,070,727

[45] Jan. 31, 1978

[54] DEVICE FOR AUTOMATIC DOOR CLOSING

[76] Inventor: Kazuyoshi Kanou, 81-49, Oaza Matsugo, Tokorozawa, Saitama, Japan

[21] Appl. No.: 760,434

[22] Filed: Jan. 18, 1977

[30] Foreign Application Priority Data

June 29, 1976 Japan ..... 51-84590

[51] Int. Cl.[2] ..... E05F 1/08; E05F 5/06

[52] U.S. Cl. ..... 16/72; 16/73; 16/85

[58] Field of Search ..... 16/72, 73, 71, 78, 79, 16/80, 85; 49/386

[56] References Cited

U.S. PATENT DOCUMENTS

| | | | |
|---|---|---|---|
| 1,319,554 | 10/1919 | Anderson | 16/73 |
| 2,011,694 | 8/1935 | Stevens | 16/73 |
| 2,730,774 | 1/1956 | Sagstven | 16/72 |
| 3,137,889 | 6/1964 | Sogian | 16/73 |
| 3,329,991 | 7/1967 | Gobble | 16/72 X |
| 3,385,344 | 5/1968 | Andrews | 16/73 |
| 3,785,006 | 1/1974 | Metz | 16/73 |

FOREIGN PATENT DOCUMENTS

| | | | |
|---|---|---|---|
| 521,705 | 5/1940 | United Kingdom | 16/73 |

*Primary Examiner*—Ronald Feldbaum
*Attorney, Agent, or Firm*—Haseltine, Lake & Waters

[57] ABSTRACT

A device for automatic closing of a door includes a plate spring of predetermined length, having an arcuate cross-section and a center section. The spring is bent about the center section at an angle deviating slightly from a straight line. The door may be opened and closed about a hinge, and the spring ends are attached to a wall and the door, respectively.

4 Claims, 11 Drawing Figures

FIG. 9
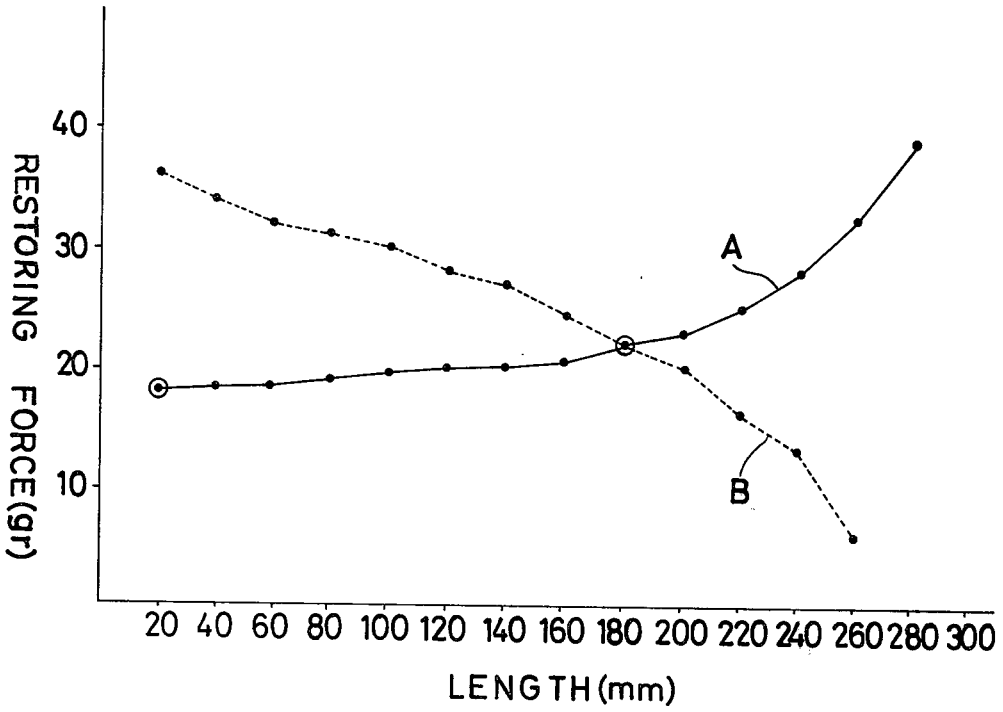
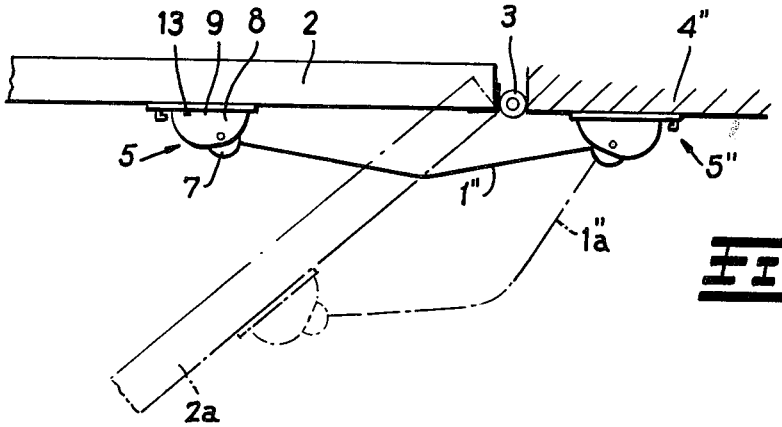
FIG. 2 a

DEVICE FOR AUTOMATIC DOOR CLOSING

FIELD OF THE INVENTION

The present invention relates to an automatic closing apparatus for a door arranged to be opened and closed about a hinge on one side thereof, wherein a flat strip type plate spring having special characteristics is used for an automatic door closing.

SUMMARY OF THE INVENTION

I accordingly provide a device for automatic closing of a door which includes a plate spring of predetermined length, having an arcuate cross-section and a center section; the spring has first and second ends and is bent about the center section at an angle deviating slightly from a straight line. The device includes a stationary wall, a hinge attached to the wall, and a door openable and closeable about the hinge. The first spring end is attached to the wall, and the second spring end is attached to the door.

First and second attachment members are preferably attached to the door and the wall, respectively, and the first and second spring ends are attached to the first and second attachment members, respectively.

The plate spring is preferably made of steel, its predetermined length being about 300 mm; the spring has a width of about 13 mm and a thickness of about 0.15 mm, and its cross-section is preferably S-shaped.

BRIEF DESCRIPTION OF THE DRAWING

My invention will be better understood with reference to the accompanying drawing, in which:

FIG. 2*a* is a variant of the apparatus shown in FIG. 2;

FIG. 9 is a diagram showing a comparison of restoring force characteristics of a plate spring according to the present invention, and that of a conventional plate spring of the prior art.

DESCRIPTION OF THE PREFERRED EMBODIMENTS

Figure 5:
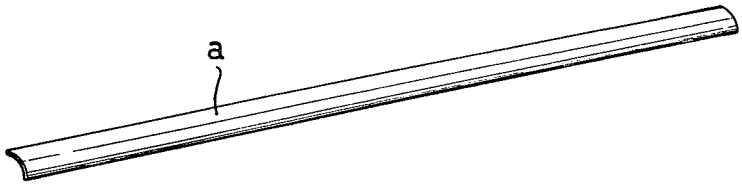
FIG. 5 is a perspective view of one example of a flat strip-type plate spring used in the apparatus.
Figure 6:
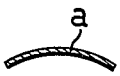
FIGS. 6*a* and *b* are cross-sectional views of different plate springs used in the apparatus, respectively.
Figure 6:
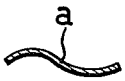
Figure 7:
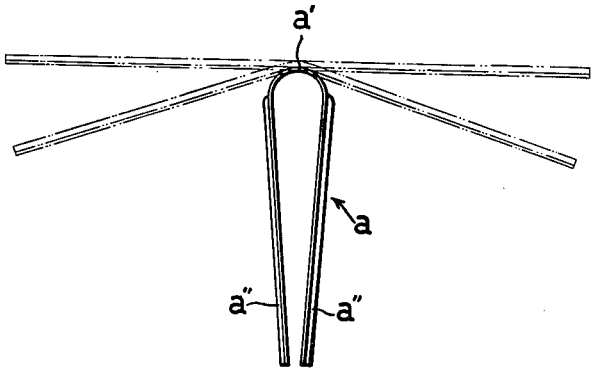
FIG. 7 is an explanatory diagram illustrating the bending property of this plate spring, according to the present invention.

A flat strip type of plate spring used in the present invention is shown in FIGS. 5 to 7, and its curved cross-section may have any desired shape, such as an arc, as shown in FIG. 6*a,* an S-shape, as shown in FIG. 6*b,* or the like.

When a plate spring *a* having a curved form in cross-section is bent at its middle portion, as shown in FIG. 7, a bent portion *a'* of the resultant arc is deformed, while each side portion *a''* integrally extending therefrom maintains its stiffness and remains straight.

In the event the plate spring *a* is bent at its middle portion, the spring having a cross-section in the form of an arc as shown in FIG. 6*a,* a bending stress results which depends on the bending direction. In the case of a plate which has an S-shaped cross-section, for example, the spring shown in FIG. 6*b,* the bending stress is equal in either direction of bend and thus the spring can be used without directionality.

Figure 8:
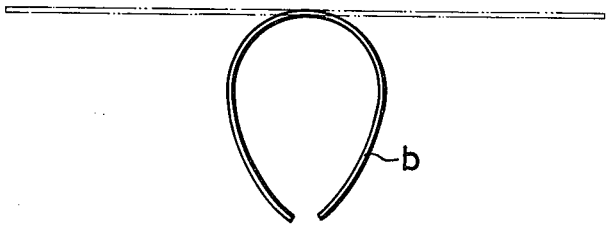
FIG. 8 is an explanatory diagram illustrating the bending property of a conventional plate spring of the prior art.

The restoring force of the flat spring *a* upon being restored toward its original linear condition from a previous bent state yields a characteristic so that the restoring force is almost constant in value over the range the plate spring *a* is bent, as shown by the solid lines in FIG. 7, up to the condition where the plate spring *a* is bent in a wide open V form, as shown by the broken lines in the same figure; thereafter the restoring force increases rapidly, i.e., from the wide open V form upwards to the straight state. When a conventional plate spring which is flat in cross-section, as shown in FIG. 8, is bent as shown by the solid lines in the same Figure, into a circular arc form throughout the whole of its length, the restoring force gradually decreases, however, as the spring is being restored towards its original linear state, so that the restoring force of the plate spring *a* having a curved cross-section has a characteristic quite different from that of the flat spring.

FIG. 9 is an experimental diagram showing the restoring force characteristics of the plate spring, according to the present invention, and that of a conventional plate spring. The plate springs used in this experiment are both made of resilient steel, are 300 mm in length, 13 mm in width and 0.15 mm in thickness, and the plate spring according to the present invention has an S-shaped cross-section.

In this diagram, A shows the restoring force characteristics of the plate spring *a* according to the present invention, and B shows that of the conventional plate spring *b.* As shown in this diagram, the restoring force of the plate spring *a* is 18 grs. when the spring *a* of 300 mm length is bent to such an extent that the length between both of its ends is 20 mm, — the extent being shown by the solid lines in FIG. 7 -, and this force remains substantially unchanged, having an almost constant value until the spring *a* is restored to its bent condition of 180 mm in length and then has a restoring force of 22 grs.; the restoring force rapidly increases until the spring *a* is restored to its original linear condition upon exceeding the length of 180 mm. The restoring force becomes about 40 grs. when its length becomes 280 mm, as in the wide open V form condition shown in FIG. 7. Thus, the restoring force characteristic of the plate spring *a* is entirely different from that of the conventional plate spring *b* shown by the curve B.

Figure 1:
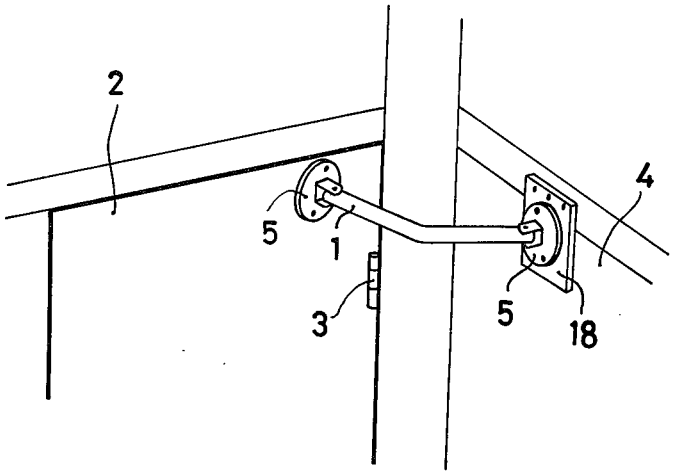
FIG. 1 is a perspective view of one example of the automatic door closing apparatus, according to my invention.

Thus, according to the present invention, an automatic closing apparatus for a door is constructed by utilizing a plate spring yielding a linear condition, having a curved cross-section and producing a large restoring force when somewhat bent at its middle portion. A construction is therefore employed in the apparatus, according to the present invention, as shown in FIG. 1, so that a flat strip plate spring 1 of a suitable length having a curved cross-section is disposed so as to be somewhat bent at its middle portion, between a door 2 arranged to be opened and closed about a hinge 3 on one side thereof, and a stationary wall 4, and respective ends of the spring 1 are connected to the door 2 and the stationary wall 4 directly, or through suitable attachment members 5.

In the illustration, the door 2 and the stationary wall 4 are disposed in a 90° relationship, but the present invention is applicable also to a case where the door 2 and the stationary wall 4 are disposed in a 180° relationship as shown in FIG. 2*a*, the solid lines 1″ and 1″*a* representing the open and partially closed positions of the door, respectively.

Figure 2:
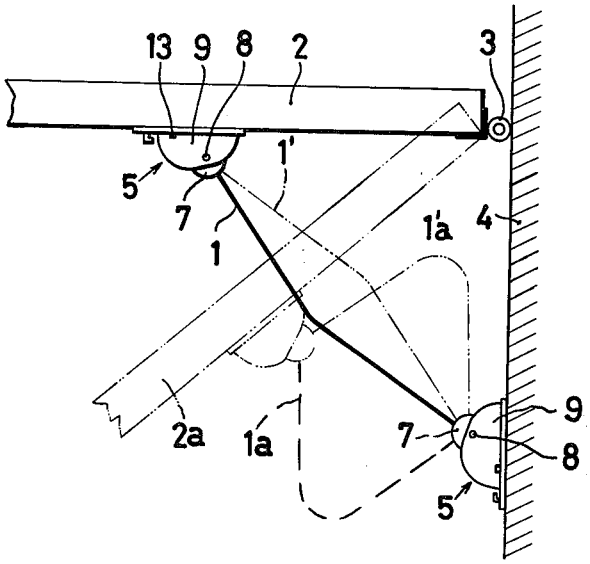
FIG. 2 is a top plan view of an essential portion of another example of the apparatus, according to my invention.

In an automatic door closing operation, according to the present invention, as shown in FIG. 2, the plate spring 1 is somewhat bent in one direction in a wide open V form when the door is closed. In this case the plate spring 1 may be bent either to project outwards as shown by solid lines 1 in FIG. 2, or to project inwards as shown by broken lines 1′ in the same Figure. Accordingly, in this condition the door 2 is kept closed by the restoring force due to the characteristics of the plate spring 1, as has been mentioned before, and the restoring force of the plate spring 1 at that time is maximum.

If the door 2 is opened from this condition to a halfway point as shown by dotted lines 2*a*, the plate spring 1 is then bent, as shown by dotted lines 1*a*. After the door 2 is thus opened from the condition shown by the solid lines so as to bend the plate spring 1 to change from the wide open V condition into the bent condition shown by the dash-dot lines 1*a*, and if the door in the condition 2*a* is then further opened to bend the plate spring 1 beyond the condition shown by the dash-dotted lines 1*a*, the restoring force of the plate spring will then scarcely be changed at all. Accordingly, such characteristics require a large force for opening the door initially, but any further opening of the door can be carried out subsequently by a comparatively light force. Alternate opening and closing positions are shown by lines 1′ and 1′*a*, respectively.

If the door 2, after having been opened, is released from the user's hold, the door 2 is then urged to move in a closing direction, with the connecting portion of the stationary wall 4 serving as a fixed reference plane, by the restoring force of the plate spring 1 urging it to be restored from its strongly bent condition to its original form, so that finally the plate spring 1 is restored to its open V-shape state, and the door 2 is thus firmly closed by the maximum force acting thereon.

Figure 4:
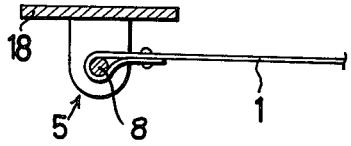
FIG. 4 is a sectional view of an attachment member portion in FIG. 1.

As regards the manner of connecting the respective ends of the plate spring 1 to the door 2 and the stationary wall 4, the end portion of the plate spring 1 may be secured thereto either directly by means of a nail or the like, or the end portion of the plate spring 1 may be rotatably connected to a lateral type of pivot member 8 by winding it thereround as shown, for example, in FIG. 4, or an attachment member 5 having an outline as shown in FIG. 2 may be used.

Figure 3:
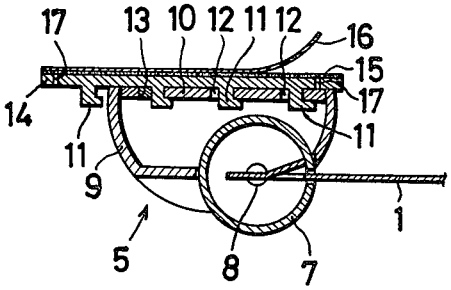
FIG. 3 is a sectional side view of an attachment member used in the examples of FIGS. 2 and 2*a;*

The attachment member 5 is constructed, for example, as shown in FIG. 3, so that a ball-shaped body 7, to which the plate spring 1 is connected so that one end of the spring 1 is arranged to remain inserted therein, is rotatably mounted at both of its lateral pivot members 8 in a bowl-shaped receiving member 9. A bottom plate 10 of the receiving member 9 is provided with an attachment plate 14, which latter is detachable therefrom and changeable in position by means of projecting members 11. Openings 12 are formed in the plate 14 for receiving respective projecting members 11, and a stopper member 10 is detachably inserted into at least one of the openings 12 for restraining the inserted projecting members 11. The attachment plate 14 is provided on its surface with an adhesive layer 15, so that it may be affixed to the surface of the door 2, or to the stationary wall 4 after a protective layer 16 previously affixed to the surface of the adhesive layer 15 has been peeled off; additionally the attachment plate 14 is formed with holes 17 so that it may additionally be nailed to the corresponding supporting member.

In case a direct or indirect connection of the plate spring 1 to the door 2, or to the stationary wall 4 turns out to be unstable or difficult, a supplementary plate 18 is used as shown in FIG. 1. After the plate 18 has been nailed to a suitable supporting portion, the end portion of the plate spring 1 is attached thereto directly, or through the attachment member 5, as mentioned before.

Thus, according to the present invention, a flat strip-type plate spring 1 of a desired length and having a curved cross-section is connected to extend between a door 2 and a stationary wall 4, so that door can be opened relatively easily on account of the characteristics of the plate spring 1 due to its curved cross-section, and the door may be closed reliably by utilizing the maximum restoring force of the plate spring; thus the apparatus is extremely simple, accurate in operation and inexpensive, and easily attachable to existing doors.

What is claimed is:

1. A device for automatic closing of a door comprising:

a plate spring of predetermined length, having an arcuate cross-section and a center section, said spring having first and second ends and being bent about said center section at an angle deviating slightly from a straight line;

a stationary wall;

a hinge attached to said wall; and a door openable and closeable about said hinge, the first spring end being attached to said wall and the second spring end being attached to said door.

2. A device according to claim 1 further comprising first and second attachment members attached to said door and said wall, respectively, said first and second spring ends being attached to said first and second attachment members, respectively.

3. A device according to claim 1 wherein said plate spring is made of steel, the predetermined length being about 300 mm, said spring having a width of about 13 mm and a thickness of about 0.15 mm.

4. A device according to claim 1 wherein said cross-section is S-shaped.

* * * * *